US005271353A

United States Patent [19]

Besthorne

[11] Patent Number: 5,271,353

[45] Date of Patent: Dec. 21, 1993

[54] MEDICINE MINDER

[76] Inventor: Gerard Besthorne, 22 Augusta St., Irvington, N.J. 07111

[21] Appl. No.: 651,181

[22] Filed: Feb. 6, 1991

[51] Int. Cl.[5] ..... G09F 9/00

[52] U.S. Cl. ..... 116/308; 116/318

[58] Field of Search ..... 116/308, 309, 311, 316, 116/318, 319, 320; 40/310, 607, 633, 665

[56] References Cited

U.S. PATENT DOCUMENTS

| | | | |
|---|---|---|---|
| 337,713 | 3/1886 | Snypp | 40/310 |
| 612,296 | 10/1898 | Woodward | 116/308 |
| 1,221,572 | 4/1917 | Morton | 40/310 |
| 1,397,079 | 11/1921 | Cohen | 40/665 |
| 1,421,219 | 6/1922 | Harmon | 40/310 |
| 1,796,398 | 3/1931 | Richardson | 116/308 |
| 1,946,385 | 2/1934 | Bryant | 116/311 |
| 2,138,422 | 11/1938 | Halpin | 116/311 |
| 2,625,131 | 1/1953 | Sturhahn | 116/308 |
| 3,853,090 | 12/1974 | Watson et al. | 116/312 |
| 4,536,758 | 8/1985 | Schweitzer, Jr. | 340/664 |
| 5,129,352 | 7/1992 | Roberts | 116/308 |

FOREIGN PATENT DOCUMENTS

| | | | |
|---|---|---|---|
| 0035298 | 1/1906 | Fed. Rep. of Germany | 116/308 |
| 0546640 | 11/1922 | France | 40/665 |
| 1121018 | 7/1968 | United Kingdom | 40/310 |

*Primary Examiner*—William A. Cuchlinski, Jr.
*Assistant Examiner*—John L. Beres
*Attorney, Agent, or Firm*—Richard L. Miller

[57] ABSTRACT

A medicine reminder device for a medicine container is provided and consists of a mechanism for removably attaching a housing having a clock face thereon to the medicine container. Hour and minute hands are pivotally mounted to the clock face so that a person can manually move the hour and minute hands to indicate the time medicine must be taken from the medicine container.

2 Claims, 1 Drawing Sheet

MEDICINE MINDER

BACKGROUND OF THE INVENTION

The instant invention relates generally to a medicine reminder device.

Numerous indicating instruments have been provided in the prior art that are adapted to aid people when the proper administration of medications are scheduled to be taken at different time intervals. For example, U.S. Pat. Nos. 4,345,541 to Villa-Real; 4,405,045 to Villa-Real and 4,756,432 to Holtsch all are illustrative of such prior art. While these units may be suitable for the particular purpose to which they address, they would not be as suitable for the purpose of the present invention as hereafter described.

SUMMARY OF THE INVENTION

A primary object of the present invention is to provide a medicine reminder device that will overcome the shortcomings of the prior art devices.

Another object is to provide a medicine reminder device that contains a clock face with manually movable hour and minute hands to indicate the time a person must take medicine from a container that the device is attached to.

An additional object is to provide a medicine reminder device that is fabricated so that it can be removably attached to the cylindrical body of different diameter medicine containers.

A further object is to provide a medicine reminder device that is simple and easy to use.

A still further object is to provide a medicine reminder device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 5:
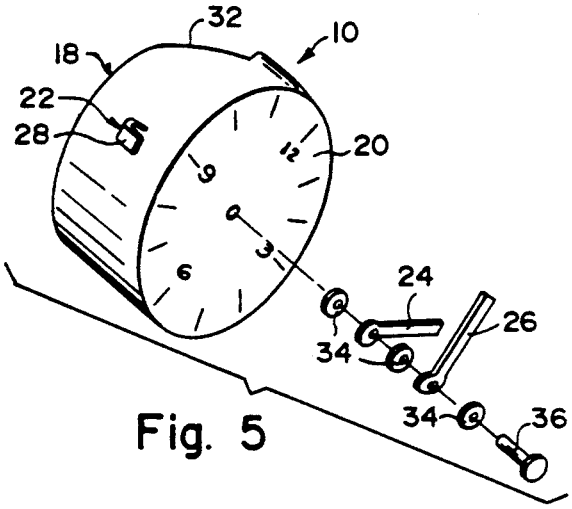
FIG. 5 is an exploded diagrammatic perspective view
Figure 3:
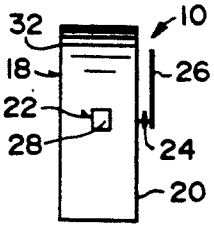
FIG. 3 is a diagrammatic side view taken in the direction of arrow 3 in FIG. 2.
Figure 2:
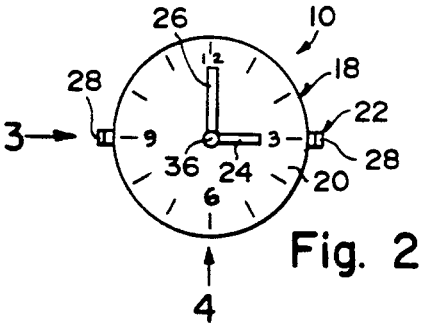
FIG. 2 is a diagrammatic front view taken in the direction of arrow 2 in FIG. 1 of just the instant invention per se.
Figure 4:
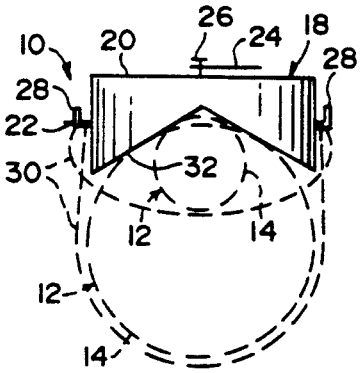
FIG. 4 is a diagrammatic bottom view taken in the direction of arrow 4 in FIG. 2.
Figure 1:
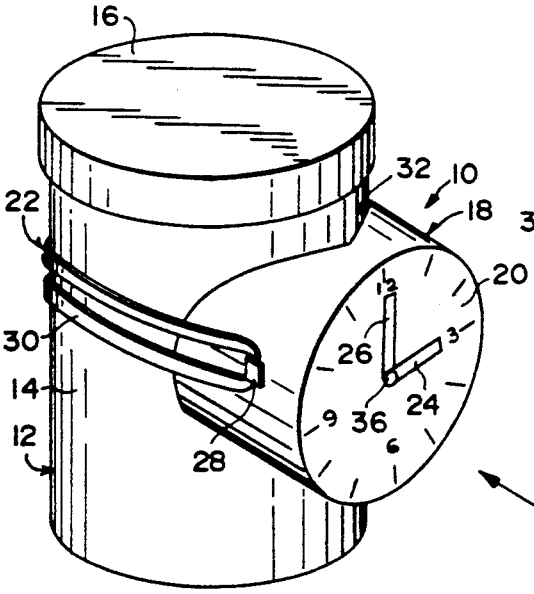
FIG. 1 is a diagrammatic perspective view illustrating the instant invention installed on a large medicine container.
Figure 1A:
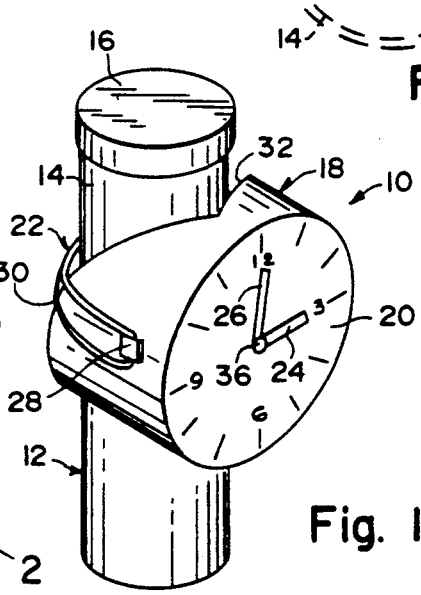
FIG. 1A is a diagrammatic perspective view illustrating the instant invention installed on a small medicine container.

Turning now descriptively to the drawings, in which like reference characters denote like elements throughout the several views, the Figures illustrate a medicine reminder device 10 for a medicine container 12 having a cylindrical body 14 and a cap 16. The device 10 consists of a housing 18 having a clock face 20 thereon. A mechanism 22 is for removably attaching the housing 18 to the cylindrical body 14 of the medicine container 12. Hour and minute hands 24 and 26 are pivotally mounted to the clock face 20 of the housing 18 so that a person can manually move the hour and minute hands 24 and 26 to indicate the time the person must take medicine from the medicine container 12.

The mechanism 22 includes a pair of hook members 28, each affixed to an opposite side of the housing 18 and an elastic band 30 engageable with the hook members 28 so that the elastic band 30 can wrap around the cylindrical body 14 of the medicine container 12.

The housing 18 further includes a V-shaped back wall 32 so that the medicine reminder device 10 can be removably attached to any sized diameter of cylindrical body 14 of the medicine container 12.

Three rubber washers 34 and a rivet 36 are provided for pivotally mounting the hour and minute hands 24 and 26 to the clock face 20 of the housing 18 in a tight condition so as to allow the hour and minute hands 24 and 26 to be manually moved hereabout and stay in position.

To use the medicine reminder device 10, a person simply places the elastic band 30 on the hook members 28 about the body 14 of the medicine container 12 and sets the hour and minute hands 24 and 26 to the proper time when the person must take the medicine. After the person removes the cap 16, takes the medicine and replaces the cap 16 the hour and minute hands 24 and 26 can be reset for the next time when the person must take the medicine. This eliminates errors and mistakes for the person who must take the medicine at exact timed intervals during the day.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A medicine reminder device for a medicine container of the type having a cylindrical body and a cap, said device comprising:

a) a substantially rigid housing having a clock face on a front thereof and a V-shaped back wall;

b) an elastic band affixed to the housing so that said elastic band can wrap around the cylindrical body of the medicine container removably attaching said housing to any sized diameter of cylindrical body of the medicine container; and c) an hour and minute hand pivotally mounted to the clock face of said housing in tight condition by a rivet and three rubber washers interposed between the rivet, said hour and minute hand and the clock face, respectively, so that a person can manually move said hour and minute hand merely by finger pressure in the direction of rotation to indicate a time that the person must take medicine from the medicine container and that the hands will stay in position.

2. A medicine reminder device as recited in claim 1, wherein said elastic band is affixed to the housing by a) a pair of hook members, each affixed to an opposite side of said housing and said elastic band is engageable with said hook members.

* * * * *